United States Patent [19]

Ono et al.

[11] Patent Number: 4,934,686

[45] Date of Patent: Jun. 19, 1990

[54] SHEET FEEDING APPARATUS WITH A CONSTANT FRICTION TORQUE GENERATING MECHANISM

[75] Inventors: Hironori Ono, Hirakata; Yoshito Urata, Katano, both of Japan

[73] Assignee: Matsushita Electric Industrial Co., Ltd., Osaka, Japan

[21] Appl. No.: 279,104

[22] Filed: Dec. 2, 1988

[30] Foreign Application Priority Data

Dec. 10, 1987 [JP] Japan ..... 62-312709

[51] Int. Cl.[5] ..... B65H 3/06

[52] U.S. Cl. ..... 271/117; 271/116; 271/118

[58] Field of Search ..... 271/10, 21, 109, 113, 271/114, 115, 116, 117, 118, 121; 192/415, 81 C, 58 B

[56] References Cited

U.S. PATENT DOCUMENTS 2,629,472 2/1953 Sterner ..... 192/58 B
3,893,554 7/1975 Wason ..... 192/415 X
4,262,894 4/1981 Marano ..... 271/118 X
4,699,366 10/1987 Kashimura et al. ..... 271/118 X

FOREIGN PATENT DOCUMENTS 50-4332 2/1975 Japan .
53-50341 12/1978 Japan .
56-64356 6/1981 Japan .
0257841 11/1986 Japan ..... 271/118

*Primary Examiner*—Joseph J. Rolla
*Assistant Examiner*—Edward S. Ammeen
*Attorney, Agent, or Firm*—Wenderoth, Lind & Ponack

[57] ABSTRACT

In a sheet feeding apparatus, a member, supporting at one end thereof a rotatable pressure roller, is mounted turnably at the other end thereof on an input shaft driven by a motor. This member is coupled to the input shaft via a friction generating mechanism which generates a friction force. This friction force allows the rotatable pressure roller to be pressed with an optimum pressure onto a sheet to be fed.

12 Claims, 5 Drawing Sheets

SHEET FEEDING APPARATUS WITH A CONSTANT FRICTION TORQUE GENERATING MECHANISM

BACKGROUND OF THE INVENTION:

1. Field of the Invention:

The present invention relates to a paper sheet feeder for feeding a cut sheet such as paper into an apparatus which uses the cutting sheet, such as a copying machine, printing machine, etc.

2. Description of the Prior Art:

The cut sheets which are presently used for apparatus such as copying machines are different in their material quality, thickness, surface condition, etc., and the sheet feeder for feeding such sheets into the apparatus must be capable of properly feeding these different qualities of cut sheets.

A construction of the conventional sheet feeder for a copying machine is disclosed in Japanese Patent Publication (Unexamined) No. 56-64356/1981, according to which a cut sheet of paper is held up, pressed onto a feed-in roller, and under the rotating force of the feed-in roller conveyed by a frictional force into the copying machine. At this time, the pressing force exerted between the paper and the feed-in roller is generally produced by the recovery force of a spring. However, according to such construction, the pressing force varies because the recovery force of the spring varies depending on the size of the paper and the remaining number of sheets. Further, a motive power source which consumes additional energy is required to provide a torque for holding up the piled sheets of paper. Further, such an arrangement necessitates the use of cams and clutches. The increased number of parts leads to a higher cost.

SUMMARY OF THE INVENTION:

An object of the present invention is to provide a sheet feeding apparatus which eliminates or reduces the variation of the pressing force between the feed-in roller and the cut sheet that may be caused by the difference in the kind or size of the cut sheet fed into a main apparatus.

A sheet feeding apparatus according to the present invention comprises a loading means for loading a sheet; pickup means having a roller which is rotatable itself and movable between a position of tight contact with the sheet and a position of separation from the sheet; driving means for generating torque for rotating and turning said pickup means; connecting means for connecting said pickup means with said driving means; and a torque generating means for transmitting a prescribed driving torque to said connecting means so as to bring said sheet into tight contact with said pickup means at a prescribed pressure.

Figure 1:
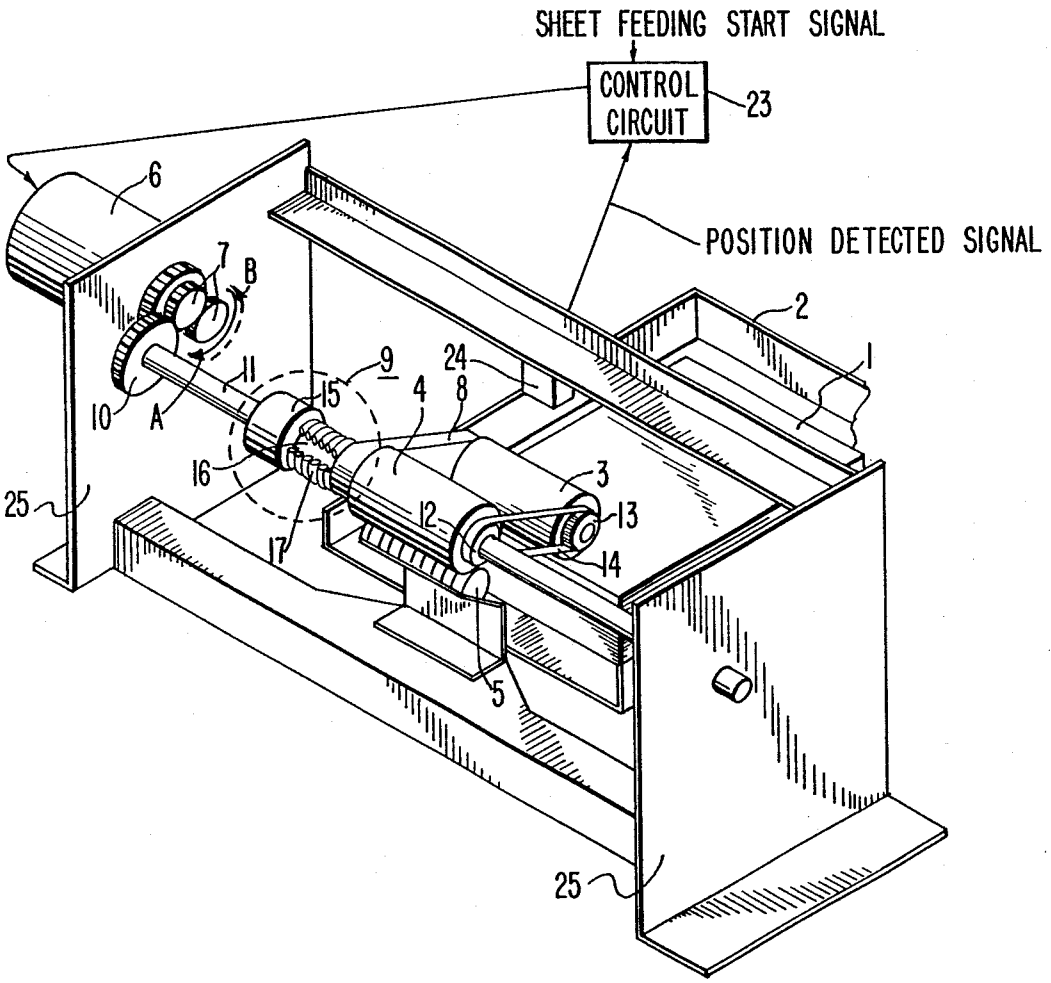
FIG. 1 is a perspective view of a sheet feeding device according to one embodiment of the present invention.

DESCRIPTION OF THE PREFERRED EMBODIMENTS:

FIG. 1 is a perspective view of the paper sheet feeding device according to one embodiment of the present invention. Stacked sheets 1 to be fed into a copying machine (not illustrated) are loaded on a tray 2 and held in position. A pick-up roller 3 comprises an elastic member for carrying out stabilized feeding of a cut sheet 1 loaded on tray 2. A feed roller 4 comprises an elastic member and is provided upstream of the pick-up roller 3. A member 5 provided adjacent the feed roller 4 comprises a guiding member for guiding a cut sheet 1 sent forward by the pick-up roller 3 into an apparatus such as a copying machine. A motor 6 is provided for driving the pick-up roller 3 and the feed roller 4, and is capable of rotating in a direction for feeding the cut sheet 1 and in a direction opposite thereto. Gears 7 are mounted to a chassis 25 so as to transmit the driving force of the motor 6 to the pick-up roller 3 and the feed roller 4, and are generally supported in a freely rotatable manner on pins provided on the chassis 25. Further, in order that the pick-up roller 3 be capable of rotating about the rotary axis of the feed roller 4, there is provided a supporting member 8 for connecting the pick-up roller 3 with a rotary shaft 11 of the feed roller 4. A torque generating mechanism 9 is provided to generate a pressure contact force between the pick-up roller 3 and the cut sheet 1 by imparting a rotary torque to the supporting member 8. Detailed construction of the torque generating mechanism 9 will be explained later.

Figure 4:
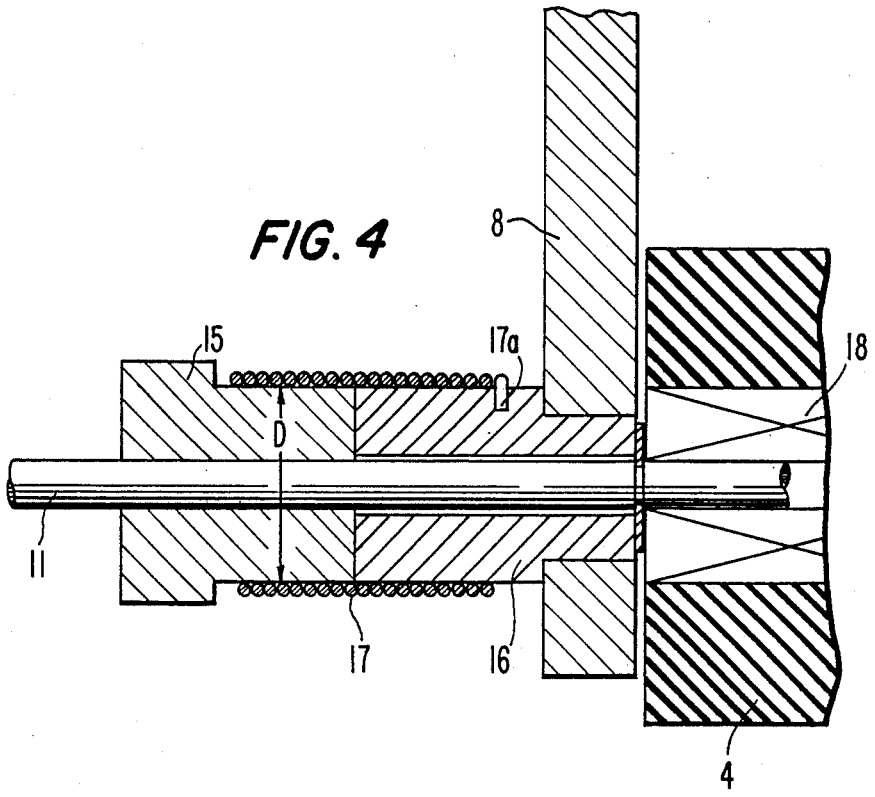
FIG. 4 is a sectional view showing a construction of one embodiment of the torque generating means according to the present invention.
Figure 4A:
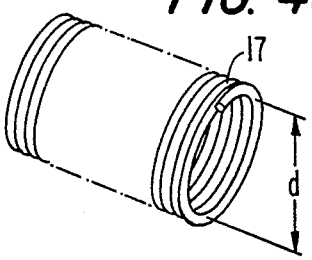
FIG. 4*a* is a perspective view of the coil spring used in the embodiment shown in FIG. 4.

A gear 10 is an input shaft gear and, of the gears 7 of the gear train, is positioned nearest to the paper feed roller 4. Rotary shaft 11 is an input shaft fixed to the input shaft gear 10. The feed roller 4 is supported on the input shaft 11 by means of a one-way clutch 18 as shown in FIG. 4 so that, when the input shaft 11 rotates in the direction in which it feeds the cut sheet 1 into the apparatus, the feed roller 4 also rotates, but when the input shaft 11 rotates in the reverse direction, the feed roller 4 does not rotate. A feed roller side pulley 12 is fixed on the side of the feed roller 4. A pick-up roller side pulley 13 is fixed on the side of the pick-up roller 3. A toothed timing belt 14 couples pulley 12 with the pulley 13. The driving force of the motor 6 is transmitted to the input shaft 11, the feed roller 4, the feed roller side pulley 12, the timing belt 14, and the pick-up roller side pulley 13 to rotate the pick-up roller 3.

Construction of the torque generation mechanism 9 will be explained with reference to the drawings. In FIG. 4, the first embodiment of the construction is shown. There are provided an input side boss 15 fixedly supported on the input shaft 11 and an output side boss 16 supported on the input shaft 11 in a freely rotatable manner (with its movement restricted along the longitudinal direction of the shaft). A coil spring 17 extends about the outer peripheries of both of the bosses 15 and 16. The inner diameter d of the spring 17 under free condition is smaller than the outer diameter D of each of the input and output side bosses 15 and 16. That is to say, $D>d$.

The coil spring 17 is fitted onto the outer peripheries of the input and output bosses 15 and 16 in an expanded condition. The amount of expansion at this time is expressed as $\delta$, and $\delta$ corresponds to the difference of the diameters such that: $\delta=(D-d)/2$. The friction forces generated by frictional movement between each of the input and output bosses 15 and 16 and the coil spring 17 are proportional to the expansion amount $\delta$. This friction force creates a pressure contact force between the pick-up roller 3 and the cut sheet 1.

Figure 2:
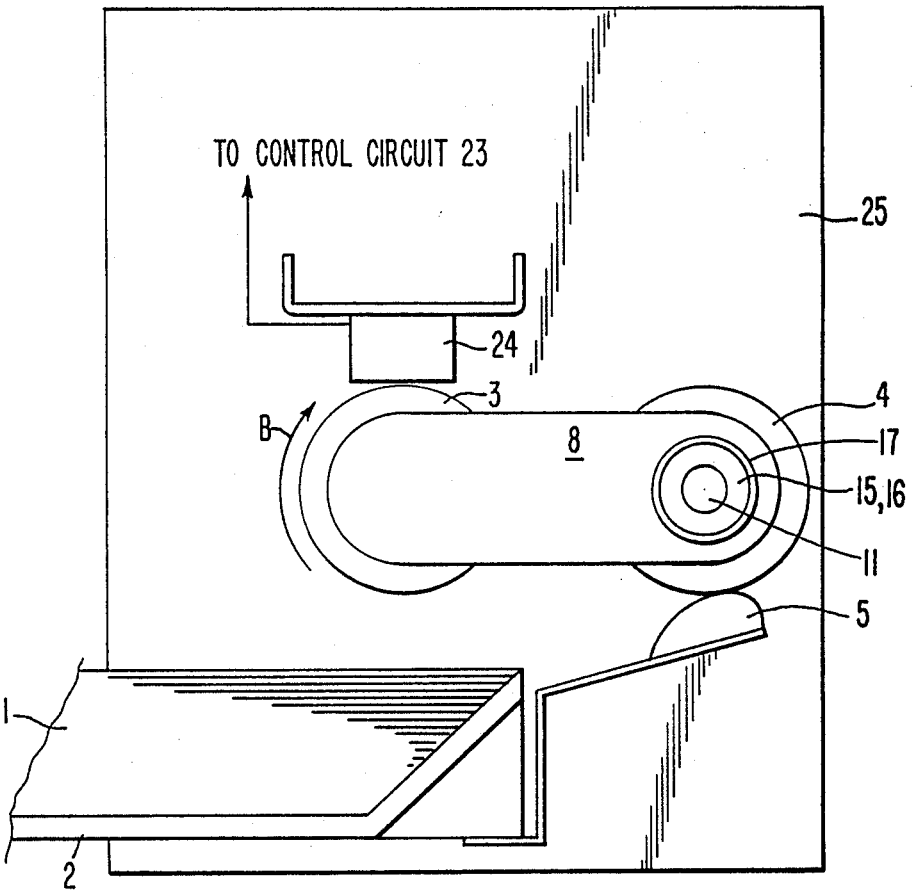
FIG. 2 is a side view of the sheet feeding device of FIG. 1 in a waiting condition.
Figure 3:
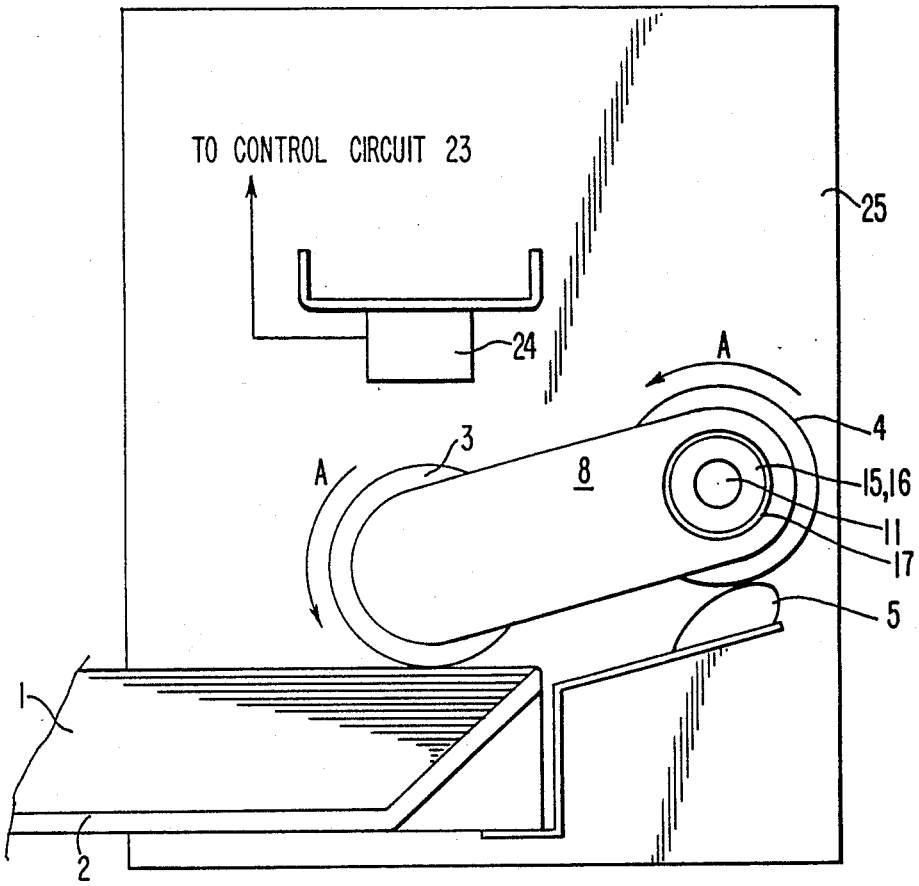
FIG. 3 is a side view of the sheet feeding device of FIG. 1 in an operating condition.

An end 17*a* of the coil spring 17 on the side of the output side boss 16 is fixed to the output side boss 16. The coil spring 17 is wound in a manner to be relaxed when the motor 6 and the input shaft 11 rotates in the direction A. When the motor 6 first starts to rotate in the direction A as shown in FIG. 2, the rotary force of the input shaft 11 is transmitted to the output side boss 16 by the friction force between the input side boss 15 and the coil spring 17, thereby causing the supporting member 8 to turn in direction A. When the supporting member 8 has been moved into operating position as shown in FIG. 3, it is in contact with cut sheet 1 and can no longer turn in the direction A. As the input side boss 15 continues to rotate, a sliding torque is generated between the coil spring 17 and the input side boss 15. This sliding torque maintains the pressure contact force between the pickup roller 3 and the cut sheet 1. The pressure contact force of the pick-up roller 3 against the cut sheet 1 can be selected by appropriately selecting at least one of: the ratio of the diameter of the input side boss 15 to the inner diameter of the coil spring 17 in free condition; the strength of the coil spring; and the friction coefficient of the outer peripheral surface of the input side boss 15.

Although, in the embodiment of FIG. 4, the coil spring 17 is fixed at its end 17*a* to the output side boss 16, it is not always necessary to fix an end of the coil spring 17 to the boss. When the two ends of the coil spring 17 are not fixed, a sliding torque is produced between the spring 17 and the boss which creates the smallest friction force against the coil spring 17. In order to differentiate the friction forces between the coil spring 17 and the respective input and output side bosses 15 and 16, the material qualities of the bosses 15 and 16 on the input and output sides may be differentiated to make the friction coefficients different from each other, or the diameters of the input and output side bosses 15 and 16 may be slightly differentiated from each other.

Alternatively, instead of the coil spring 17*a*, a friction plate may be placed between the input side boss 15 and the output side boss 16 to make frictional connection of the input and output side boss. Further, the input and output side bosses 15 and 16 may be directly brought into frictional contact with each other by suitably selecting their material qualities.

FIG. 3 shows the pick-up roller 3 in pressure contact with the cut sheet 1, i.e., the operating condition of the feed apparatus. Thereafter, after the sheet feeding operation is completed or until the next sheet feeding operation is started, it is necessary to provide a waiting condition of the roller 3 as shown in FIG. 2. This is accomplished by separating the pick-up roller 3 from the stacked sheets 1 so as to ease handling of the cut sheet 1. For this purpose, the motor 6 is rotated in the direction (B), which is opposite to the direction of rotation (A) carried out during the sheet feeding operation, to hold up the pick-up roller 3. During rotation of the motor 6 in the direction (B), the relationships discussed above between the coil spring 17 and the input and output bosses 15 and 16 are reversed with respect to the relationships during rotation of the motor 6 in the direction (A). Upon detection of the position of the pick-up roller 3 by a position sensor 24, which sends a detected signal to a control circuit 23, the control circuit 23 stops the rotation of the motor 6.

Figure 5:
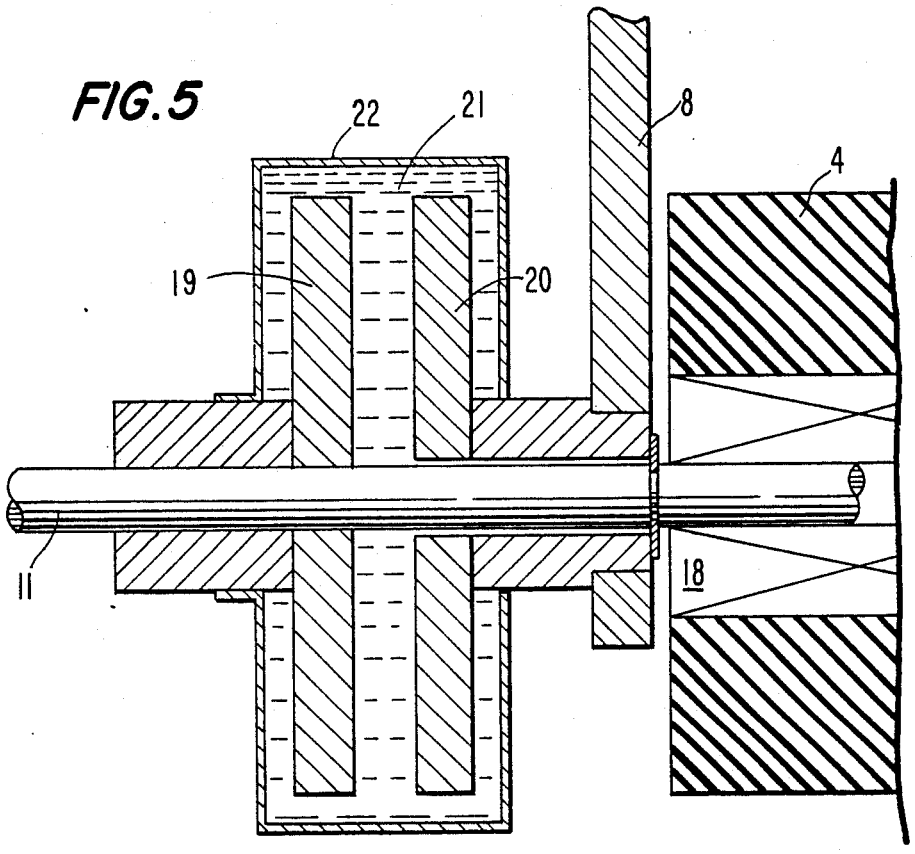
FIG. 5 is a sectional view showing a construction of another embodiment of the torque generating means according to the present invention.

In FIG. 5, there is shown a construction of another embodiment of the torque generating mechanism. There are provided an input side disc 19 fixed to the input shaft 11 and an output side disc 20 fixed to the supporting member 8 and supported in a freely rotatable manner on the input shaft 11 in spaced apart opposite relation to the input side disc 19. A viscous fluid 21 having a prescribed viscosity is filled in a casing 22 and is in contact with the input side disc 19 and the output side disc 20. Even if the input torque of the torque generating mechanism is in excess of a certain level, transmission of the torque is restricted to a maximum limit by way of the friction transmission by the viscous fluid. As such, the maximum limit value of the torque becomes the pressure contact force of the pick-up roller 3. The pressure contact force can be determined by the viscosity of the viscous fluid 21, the gap between the input and output side discs, the area of the disc surfaces, and the surface roughness of the discs.

Whenever the motor is not energized with electric power, the pick-up roller 3 is in its waiting position separated from the cut sheet 1, so as to enable replacement or replenishment of the supply of cut sheets 1. From this state, a signal for actuation of sheet feeding is sent to the motor 6 from the control circuit 23 which may be connected to a copy start button or the like (not illustrated). The motor 6 which has received this signal rotates in the paper feeding direction (direction A in FIG. 1), by which, as aforedescribed, via the torque generating mechanism 9, the pick-up roller 3 is pressed under the prescribed pressure into contact with the cut sheet 1.

On completion of the sheet feeding operation, the control circuit 23 sends a signal to cause the motor 6 to rotate in the reverse direction (direction B in FIG. 1) to the direction (A) of rotation which occurs during the sheet feeding operation. At this time, in the embodiment of FIG. 4, because the motor rotates in the direction which causes tightening of the coil spring 17, the input side boss 15 and the output side boss 16 effectively act as one piece, so that the driving force is transmitted directly to the supporting member 8. In the embodiment of FIG. 5, as the torque transmission is made by friction or viscosity in the same direction as the sheet feeding direction, the torque is exerted in a manner which causes the pick-up roller 3 and the supporting member 8 to be held in an upwardly position out of contact with the supply of cut sheets 1.

When the pick-up roller 3 and supporting member 8 are held in their upper position the position sensor 24, which may be a micro-switch, provided at a position above the cut sheet 1 senses the position and outputs a signal to stop the motor 6. As the frictional or viscous resistance of the torque generating mechanism is larger than the torque created by the weights of the pick-up roller 3 and the supporting member 8, a waiting condition as shown in FIG. 2 is maintained until the next signal for sheet feeding is supplied from the control circuit 23 to actuate the motor 6.

I claim:

1. A sheet feeding apparatus comprising:

loading means for loading a sheet;

a drive shaft rotatable about a drive shaft axis;

drive means for selectively driving said drive shaft in first and second alternate rotation directions about said drive shaft axis;

a pickup roller rotatably mounted about a rotation axis defined along a longitudinal center line of said pickup roller, and pivotally mounted for movement about said drive shaft axis between an operating position where said pickup roller is in contact with the sheet and a waiting position where said pickup roller is spaced upwardly from the sheet;

first transmitting means for transmitting rotation of said drive shaft to said pickup roller to cause rotation thereof about said rotation axis;

second transmitting means for transmitting rotation of said drive shaft to said pickup roller to cause pivotal movement of said pickup roller about said drive shaft axis toward said operating position when said drive shaft is rotated in said first direction and toward said waiting position when said drive shaft is rotated in said second direction, said second transmitting means comprising:

an input member fixed to said drive shaft for coaxial rotation therewith;

an output member rotatably mounted coaxially about said drive shaft;

third transmitting means, comprising an elongated member having a first end thereof fixed to said output member and having a second end to which is rotatably mounted said pickup roller, for transmitting rotation of said output member to said pickup roller to cause said pickup roller to move into said operating position when said output member is rotated in said first direction and to cause said pickup roller to move into said waiting position when said output member is rotated in said second direction; and fourth transmitting means, comprising a coil spring connected at one end to one of said input member and said output member and tightly wound at least on the other of said input member and said output member in such a winding direction that said coil spring is loosened when said input member is rotated by rotation of said drive shaft in said first direction and said coil spring is tightened when said input member is rotated by rotation of said drive shaft in said second direction, for transmitting rotation of said input member in said first direction to said output member until said output member encounters a predetermined resistance to rotation caused by said pickup roller contacting the sheet and for transmitting rotation of said input member in said second direction to said output member.

2. An apparatus according to claim 1, wherein said first transmitting means includes a one-way clutch means for transmitting rotation of said drive shaft through said first transmitting means to said pickup roller only when said driving shaft rotates in said first direction.

3. An apparatus according to claim 1, further comprising position detecting means for detecting when said pickup roller reaches said waiting position and for producing a detection signal indicative thereof; and control means responsive to said detection signal for stopping said drive means when said pickup roller reaches said waiting position.

4. An apparatus according to claim 1, wherein under a free condition, said coil spring has a constant inner diameter which is less than outer diameters of each of said input and output members.

5. A sheet feeding apparatus comprising:

loading means for loading a sheet;

a drive shaft rotatable about a drive shaft axis;

drive means for selectively driving said drive shaft in first and second alternate rotation directions about said drive shaft axis;

a pickup roller rotatably mounted about a rotation axis defined along a longitudinal center line of said pickup roller, and pivotally mounted for movement about said drive shaft axis between an operating position where said pickup roller is in contact with the sheet and a waiting position where said pickup roller is spaced upwardly form the sheet;

a feed roller fixed to said drive shaft for integral coaxial rotation therewith for feeding the sheet after it is picked up by said pickup roller;

first transmitting means for transmitting rotation of said drive shaft to said pickup roller to cause rotation thereof about said rotation axis;

second transmitting means for transmitting rotation of said drive shaft to said pickup roller to cause pivotal movement of said pickup roller about said drive shaft axis toward said operating position when said drive shaft is rotated in said first direction and toward said waiting position when said drive shaft is rotated in said second direction, said second transmitting means comprising:

an input member fixed to said drive shaft for coaxial rotation therewith;

an output member rotatably mounted coaxially about said drive shaft;

third transmitting means, comprising an elongated member having a first end thereof fixed to said output member and having a second end to which is rotatably mounted said pickup roller, for transmitting rotation of said output member to said pickup roller to cause said pickup roller to move into said operating position when said output member is rotated in said first direction and to cause said pickup roller to move into said waiting position when said output member is rotated in said second direction; and fourth transmitting means, comprising a coil spring connected at one end to one of said input member and said output member and tightly wound at least on the other of said input member and said output member in such a winding direction that said coil spring is loosened when said input member is rotated by rotation of said drive shaft in said first direction and said coil spring is tightened when said input member is rotated by rotation of said drive shaft in said second direction, for transmitting rotation of said input member in said first direction to said output member until said output member encounters a predetermined resistance to rotation caused by said pickup roller contacting the sheet and for transmitting rotation of said input member in said second direction to said output member.

6. An apparatus according to claim 5, wherein said first transmitting means includes a one-way clutch means for transmitting rotation of said drive shaft through said first transmitting means to said pickup roller only when said driving shaft rotates in said first direction.

7. An apparatus according to claim 5, further comprising position detecting means for detecting when said pickup roller reaches said waiting position and for producing a detection signal indicative thereof; and control means responsive to said detection signal for stopping said drive means when said pickup roller reaches said waiting position.

8. An apparatus according to claim 5, wherein under a free condition, said coil spring has a constant inner diameter which is less than an outer diameter of each of said input and output members.

9. A sheet feeding apparatus comprising:

loading means for loading a sheet;

a drive shaft rotatable about a drive shaft axis;

drive means for selectively driving said drive shaft in first and second alternate rotation directions about said drive shaft axis;

a pickup roller rotatably mounted about a rotation axis defined along a longitudinal center line of said pickup roller, and pivotally mounted for movement about said drive shaft axis between an operating position where said pickup roller is in contact with the sheet and a waiting position where said pickup roller is spaced upwardly from the sheet;

first transmitting means for transmitting rotation of said drive shaft to said pickup roller to cause rotation thereof about said rotation axis;

second transmitting means for transmitting rotation of said drive shaft to said pickup roller to cause pivotal movement of said pickup roller about said drive shaft axis toward said operating position when said drive shaft is rotated in said first direction and toward said waiting position when said drive shaft is rotated in said second direction, said second transmitting means comprising:

an input member fixed to said drive shaft for coaxial rotation therewith;

an output member rotatably mounted coaxially about said drive shaft;

third transmitting means, comprising an elongated member having a first end thereof fixed to said output member and having a second end to which is rotatably mounted said pickup roller, for transmitting rotation of said output member to said pickup roller to cause said pickup roller to move into said operating position when said output member is rotated in said first direction and to cause said pickup roller to move into said waiting position when said output member is rotated in said second direction; and fourth transmitting means, for transmitting rotation of said input member in said first direction to said output member until said output member encounters a predetermined resistance to rotation caused by said pickup roller contacting said sheet and for transmitting rotation of said input member in said second direction to said output member.

10. An apparatus according to claim 9, wherein said input member comprises an input disc;

said output member comprises an output disc disposed in parallel spaced apart relation with said input disc; and said fourth transmitting means comprises a viscous fluid disposed between said input and output discs.

11. An apparatus according to claim 9, wherein said first transmitting means includes a one-way clutch means for transmitting rotation of said driving shaft through said first transmitting means to said pickup roller only when said driving shaft rotates in said first direction.

12. An apparatus according to claim 9, wherein position detecting means for detecting when said pickup roller reaches said waiting position and for producing a detection signal indicative thereof; and control means responsive to said detection signal for stopping said drive means when said pickup roller reaches said waiting position.

* * * * *